US009795816B2

(12) United States Patent
Smith et al.

(10) Patent No.: US 9,795,816 B2
(45) **Date of Patent: *Oct. 24, 2017**

(54) SELF CONTAINED FIRE EXTINGUISHER SYSTEM INCLUDING A LINEAR TEMPERATURE SENSOR

(71) Applicant: Pacific Scientific Energetic Materials Company, Hollister, CA (US)

(72) Inventors: Brian Edward Smith, Hollister, CA (US); Mei Zhen Chen, Hollister, CA (US); Thornton Alexander McGill, III, Hollister, CA (US)

(73) Assignee: Pacific Scientific Energetic Materials Company, Hollister, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/167,445

(22) Filed: May 27, 2016

(65) Prior Publication Data

US 2017/0028239 A1 Feb. 2, 2017

Related U.S. Application Data

(63) Continuation of application No. 14/507,635, filed on Oct. 6, 2014, now Pat. No. 9,352,177, which is a (Continued)

(51) Int. Cl.

| | |
|---|---|
| ***A62C 35/00*** | (2006.01) |
| ***A62C 37/48*** | (2006.01) |
| ***A62C 37/10*** | (2006.01) |
| ***A62C 35/08*** | (2006.01) |
| ***A62C 35/58*** | (2006.01) |

(Continued)

(52) U.S. Cl.

CPC ..... *A62C 37/48* (2013.01); *A62C 3/00* (2013.01); *A62C 3/07* (2013.01); *A62C 5/006* (2013.01); *A62C 31/02* (2013.01); *A62C 35/00* (2013.01); *A62C 35/023* (2013.01); *A62C 35/08* (2013.01); *A62C 35/58* (2013.01); *A62C 35/68* (2013.01); *A62C 37/04* (2013.01); *A62C 37/10* (2013.01); *A62C 37/11* (2013.01); *A62C 99/0009* (2013.01); *A62C 99/0018* (2013.01)

(58) Field of Classification Search

CPC ..... A62C 37/48; A62C 37/04; A62C 37/10; A62C 35/68; A62C 35/023; A62C 35/58; A62C 35/08; A62C 35/00; A62C 3/07; A62C 3/00; A62C 31/02; A62C 5/006; A62C 99/0009; A62C 99/0018

USPC ..... 169/5, 9, 11, 12, 19, 26, 28, 46, 47, 54, 169/56, 60, 62, 70, 84

See application file for complete search history.

(56) References Cited

U.S. PATENT DOCUMENTS

| | | | |
|---|---|---|---|
| 3,897,828 | A | 8/1975 | Glover |
| 4,256,181 | A | 3/1981 | Searcy |

(Continued)

*Primary Examiner* — Steven J Ganey
(74) *Attorney, Agent, or Firm* — Perkins Coie LLP

(57) ABSTRACT

A self contained fire extinguisher system that does not need external power in order to sense or initiate a release of a fire suppression medium, includes components configured to utilize a linear sensor network that can be connected to at least one and/or different sources of fire suppression mediums. A linear temperature sensing cord can be routed over a large area not practical with individual sensors. The cord can also actuate several and different sources of fire suppression mediums to maximize the suppression of a fire.

19 Claims, 6 Drawing Sheets

Related U.S. Application Data continuation of application No. 13/096,901, filed on Apr. 28, 2011, now Pat. No. 8,851,197.

(51) Int. Cl.

| | |
|---|---|
| ***A62C 37/36*** | (2006.01) |
| ***A62C 35/02*** | (2006.01) |
| ***A62C 3/07*** | (2006.01) |
| ***A62C 5/00*** | (2006.01) |
| ***A62C 31/02*** | (2006.01) |
| ***A62C 3/00*** | (2006.01) |
| ***A62C 99/00*** | (2010.01) |
| ***A62C 35/68*** | (2006.01) |
| ***A62C 37/11*** | (2006.01) |

(56) References Cited

U.S. PATENT DOCUMENTS

| | | | | |
|---|---|---|---|---|
| 4,648,460 | A | 3/1987 | McCulloch | |
| 5,884,710 | A | 3/1999 | Barnes | |
| 5,915,480 | A | 6/1999 | Yemelyanov | |
| 5,992,528 | A * | 11/1999 | Parkinson | A62C 13/22 169/26 |
| 7,172,031 | B2 | 2/2007 | Piatti | |
| 8,851,197 | B2 * | 10/2014 | Smith | A62C 37/48 169/11 |

* cited by examiner

FIG. 4A
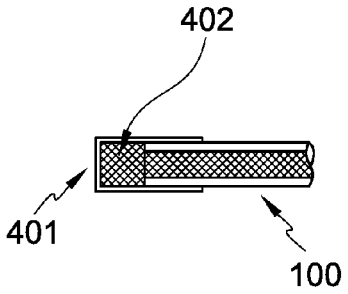
FIG. 4B
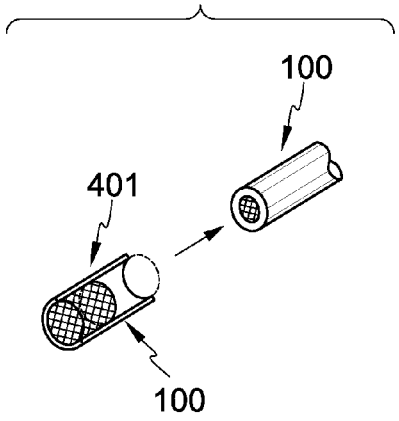
FIG. 4C
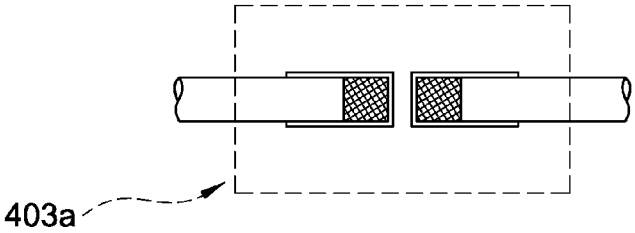
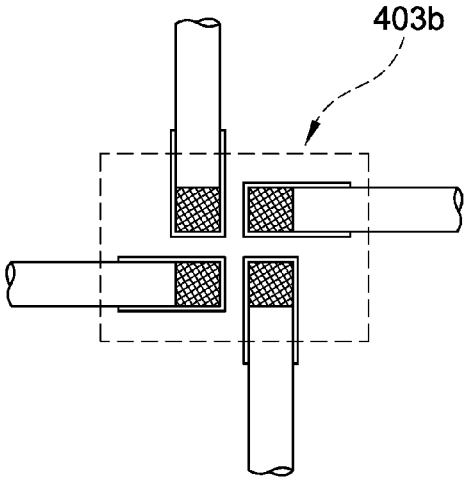
FIG. 4D

FIG. 5A
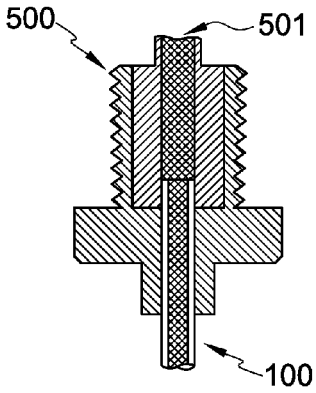
FIG. 5B
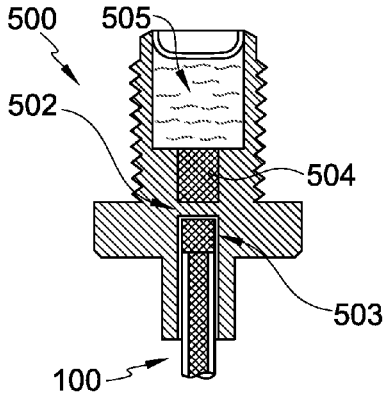
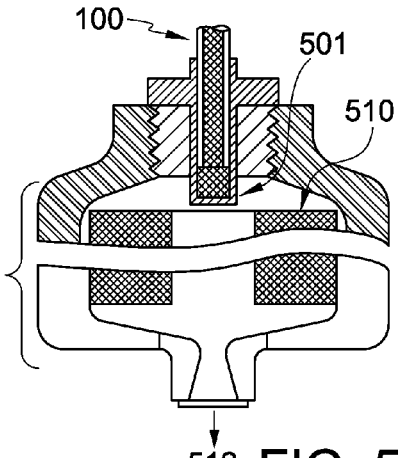
FIG. 5C
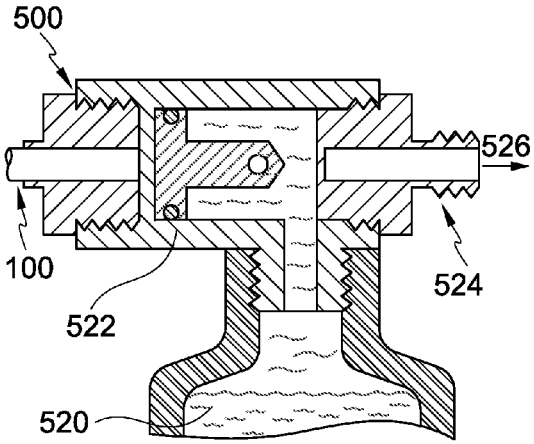
FIG. 5D
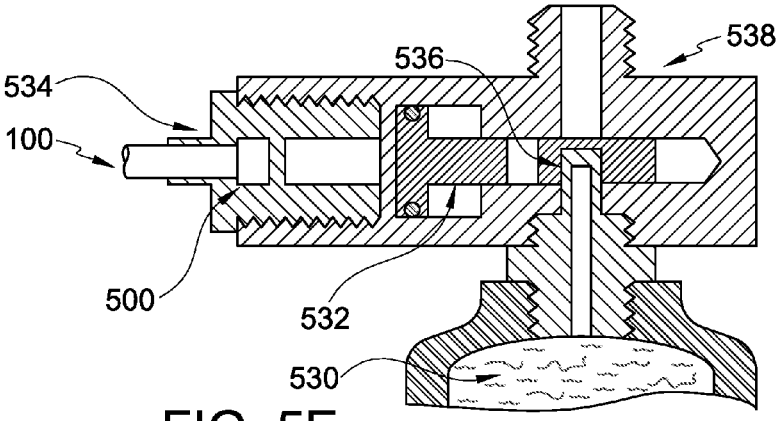
FIG. 5E

SELF CONTAINED FIRE EXTINGUISHER SYSTEM INCLUDING A LINEAR TEMPERATURE SENSOR

CROSS-REFERENCE TO RELATED APPLICATION

The present application is a continuation of U.S. patent application Ser. No. 14/507,635 titled "Self Contained Fire Extinguisher System Including A Linear Temperature Sensor" filed on Oct. 6, 2014, now allowed; which is a continuation of U.S. patent application Ser. No. 13/096,901 titled "Self Contained Fire Extinguisher System Including A Linear Temperature Sensor" filed on Apr. 28, 2011, issued as U.S. Pat. No. 8,851,197 on Oct. 7, 2014, the entire content of each of which is herein expressly incorporated by reference.

FIELD OF THE INVENTION

The present disclosure generally relates to self contained fire extinguisher systems. More particularly, the present disclosure relates to self contained fire extinguisher systems that do not need external power in order to sense or initiate a release of a fire suppression medium.

Examples of applications for embodiments according to the present disclosure include kitchens, terrestrial vehicles, marine vessels and aircraft. These applications may be civilian, commercial or military.

DESCRIPTION OF CONVENTIONAL TECHNOLOGY

Certain conventional fire extinguishing systems typically include a manually operated, pressurized source of a fire suppression medium. Other conventional fire extinguishing systems may include a sensor that requires external power to send an initiation signal to a source of a fire suppression medium, e.g., a pressurized cylinder, which is remotely located from the sensor. These sensors may detect heat and/or smoke by electrical means. If the electrical power is interrupted or disengaged by collateral damage or due to the fire, these conventional fire extinguishing systems may be rendered inoperative.

Military vehicles are examples of applications that are sensitive to loss-of-power to an onboard fire extinguishing system because the crew is frequently in close confinement with limited egress opportunity and no access to back-up fire suppression mediums. Moreover, a fire aboard a military vehicle may be caused by a landmine, projectile or other violent event that may result in immediate, collateral damage to the power network for the vehicle.

BRIEF DESCRIPTION OF THE DRAWINGS

FIG. 4A is a cross-section view of an end for the linear temperature sensor cord shown in FIG. 1A.

FIG. 4B illustrates a method of assembling the end shown in FIG. 4A.

FIG. 4C is a cross-section view of a network juncture for coupling the ends of two of the temperature sensor cords shown in FIG. 4A.

FIG. 4D is a cross-section view of a network manifold for coupling the ends of four of the temperature sensor cords shown in FIG. 4A.

FIGS. 5A and 5B are cross-section views of boost initiators coupled to ends of the linear temperature sensor cord shown in FIG. 1A.

FIGS. 5C-5E are perspective views of initiators, actuators and valves including one of the boost initiators shown in FIG. 5A or 5B.

DETAILED DESCRIPTION

The following describes embodiments of self contained fire extinguisher systems and methods of making and using self contained fire extinguisher systems in accordance with the present disclosure. Embodiments in accordance with the present disclosure are set forth in the following text to provide a thorough understanding and enabling description of a number of particular embodiments. Numerous specific details of various embodiments are described below with reference to self contained fire extinguisher systems on military vehicles, but embodiments can be used with other military, commercial or civilian vehicles, including terrestrial vehicles, marine vessels and aircraft. Embodiments of self contained fire extinguisher systems according to the present disclosure may also be used in static structures, e.g., kitchens. In some instances, well-known structures or operations are not shown, or are not described in detail to avoid obscuring aspects of the inventive subject matter associated with the accompanying disclosure. A person skilled in the art will understand, however, that the invention may have additional embodiments, or that the invention may be practiced without one or more of the specific details of the embodiments as shown and described.

Figure 1A:
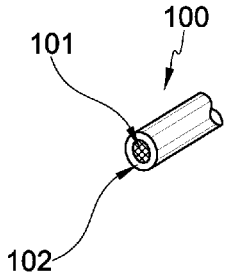
FIG. 1A is a cross-section view of an embodiment of a linear temperature sensor cord according to the present invention.

FIG. 1A shows an embodiment of a linear temperature sensor cord 100 according to the present invention. The cord preferably includes a core 101 and a casing 102. The core 101 is preferably a pyrotechnic blend of fuel and oxidizer powders with additives that result in a low auto-ignition temperature, for example, in a range of approximately 225 degrees Fahrenheit to approximately 800 degrees Fahrenheit. Generally, the range of auto-ignition temperatures is approximately 275 degrees Fahrenheit to approximately 680 degrees Fahrenheit, and preferably approximately 340 degrees Fahrenheit to approximately 400 degrees Fahrenheit. Test results have demonstrated that, in a typical diesel fuel fire and with the cord 100 spaced nominally 18 inches from the fuel, combustion of the cord 100 initiates in less than approximately 60 seconds. In addition to auto-igniting, the core 101 burns rapidly to provide a short response time, e.g., combustion propagates rapidly along the length of the cord 100. Other embodiments according to the present disclosure may have cores 101 without additives.

Embodiments of the cord 100 according to the present disclosure may have other constructions. For example, the casing 102 may include the fuel or the oxidizer and the core 101 may include the oxidizer or the fuel, respectively. Such a cord 100 may accordingly be consumed during combustion propagation. Other embodiments may include a pyrotechnic fluid core 101, e.g., a liquid or gas, that may be disposed inside or applied, e.g., sprayed, dipped, etc., onto a casing 102. Other embodiments according to the present disclosure may have other cores, e.g., a wick treated with a pyrotechnic fluid.

Figure 1B:
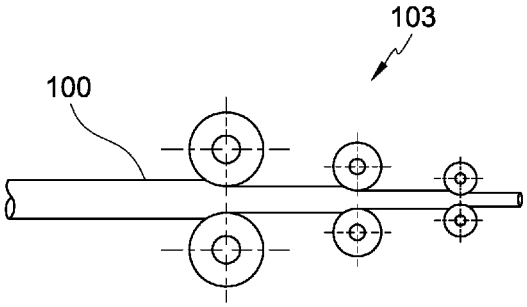
FIG. 1B illustrates a method for manufacturing the linear temperature sensor cord shown in FIG. 1A.
Figure 1C:
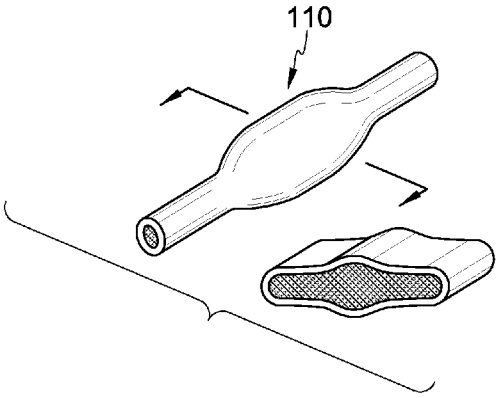
FIGS. 1C-1E are perspective and cross-section views of variations of the linear temperature sensor cord shown in FIG. 1A.

FIG. 1B illustrates a method for manufacturing the linear temperature sensor cord 100. The casing 102 preferably includes a metal tube into which the pyrotechnic blend for the core 101 is loaded. The metal tubes may then pass thru dies, rollers, or other swaging devices to elongate the tube and reduce the diameter of the cord 100. The tube material and properties may be selected for optimum thermal conductivity and tensile strength. Preferably, the diameter of the pyrotechnic core is selected for ensuring that combustion of the pyrotechnic core 101 propagates around bends formed in the cord 100. The wall thickness may be pre-determined according to the swaging procedure. The walls of the casing 102 are preferably concentric with the longitudinal axis of the cord 100 and preferably have a consistent wall thickness. Preferably, the linear temperature sensor cord 100 can be easily bent by hand or by conventional tube bending tools and techniques to conform to a selected contour or path without crimping the cord 100.

Figure 1D:
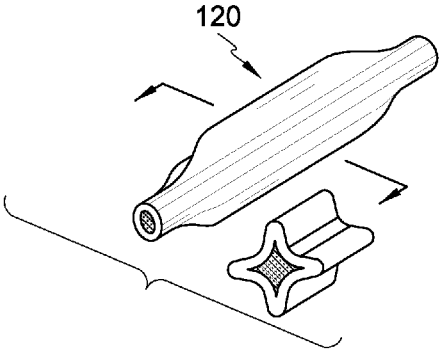
Figure 1E:
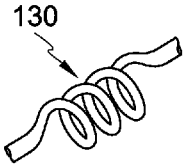

FIGS. 10-1E show arrangements of the linear temperature sensor cord 100 including features for adjusting sensitivity of the cord 100 to ambient temperature. FIG. 10 shows the cord 100 including a flattened portion 110, FIG. 1D shows the cord 100 including a portion 120 having a cross-shaped cross-section, and FIG. 1E shows the cord 100 including a coiled portion 130. The flattened portion 110, the cross-shaped portion 120, the coiled portion 130, and other arrangements may provide the cord 100 with increased temperature sensitivity by increasing the surface area and/or thinning the wall of the casing 102.

Other embodiments according to the present disclosure may have casings 102 that include materials other than metal, e.g., natural fibers, polymers or other materials through which an elevated ambient temperature may be conveyed to auto-ignite the pyrotechnic core 101. The casing 102 may also include a hybrid composition, e.g., metal fibers woven into a tubular cotton sleeve. Other manufacturing methods, e.g., extruding or weaving, may also be used for manufacturing the cord 100.

Figure 2A:
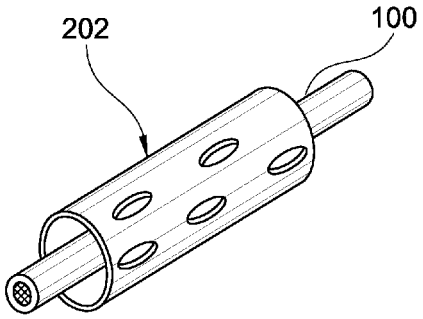
FIGS. 2A and 2B are perspective views of embodiments of protection for the linear temperature sensor cord shown in FIG. 1A.
Figure 2B:
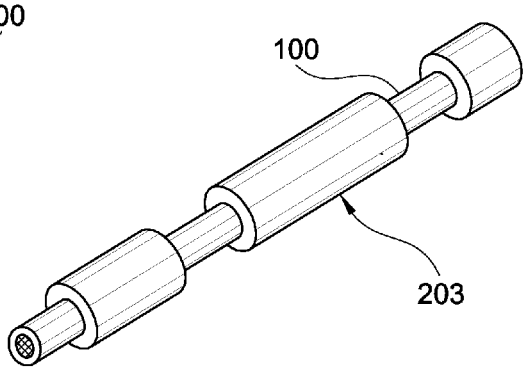

FIGS. 2A and 2B show two embodiments according to the present disclosure for partially enclosing and protecting the linear temperature sensor cord 100. In particular, it may be desirable to at least partially enclose the cord 100 to protect it from impact, abrasion or other damage in exposed areas and/or to shield the cord 100 in areas that do not require temperature sensing. The cord 100 can be inserted in a solid or perforated metal tube 202 or a non-metallic sheath 203 for protection. These protective coverings or shields may be implemented at intervals along the longitudinal axis of the cord 100, thus leaving uncovered or exposed portions along the longitudinal axis of the cord 100. Portions of the cord 100 that are covered with the sheath 203 may have reduced temperature sensitivity relative to the uncovered portions. It would therefore be preferable for sheaths 203 to be located along non-sensing lengths of the cord 100 for providing, for example, added impact or abrasion protection. The uncovered portions are preferably positioned in locations where it is desirable for the cord 100 to sense elevated ambient temperatures due to a fire. The tube 202 may provide impact protection substantially without adversely affecting the sensitivity of the cord 100. For example, the thermal conductivity and/or perforations of the tube 202 may minimize any impediment that the tube 202 may cause to the cord 100 for sensing elevated temperatures due to a fire. Accordingly, the tube 202 and/or the sheath 203 may ruggedize or provide additional protection to portions of the cord 100 without compromising the sensitivity of other portions of the cord 100.

Figure 3A:
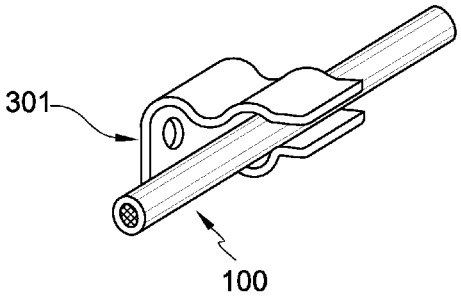
FIGS. 3A-3C are perspective views of attaching devices for the linear temperature sensor cord shown in FIG. 1A.
Figure 3B:
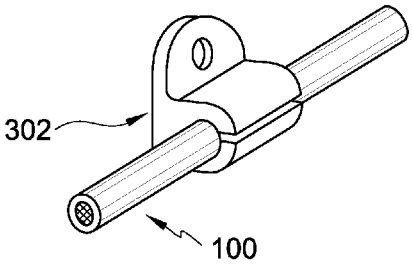
Figure 3C:
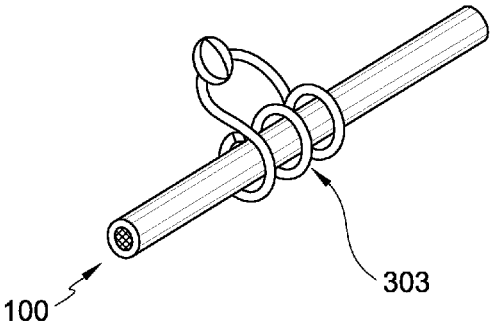

FIGS. 3A-3C show attaching devices for supporting the linear temperature sensor cord 100. FIG. 3A shows a resilient metal clip support device 301, FIG. 3B shows an elastically deformable elastomer support device 302, and FIG. 3C shows a preformed or plastically deformable wire form support device 303. The support devices 301/302/303 may support the cord relative to structures (not shown) in the temperature sensing areas. Variants of these support devices may also be used to support covered portions of the cord 100, e.g., portions of the cord 100 covered by the tube 202 or the sheath 203.

FIG. 4A shows a cup 401 enclosing an end of the linear temperature sensor cord 100, and FIG. 4B illustrates a method of assembling the cup 401 onto the cord 100. Preferably, the cup 401 includes a thin-walled metallic cup that is partially filled with additional pyrotechnic material 402. The cup 401 preferably slides onto and seals the end of the cord 100. The additional pyrotechnic material 402 may provide a booster to propagate the initiation signal across junctions or manifolds for networking plural cords 100.

The material for the cup 401 may the same or different from that of the casing 102, and the additional pyrotechnic material 402 may be the same or different from that of the core 101. Friction, adhesive, mechanical devices, or other coupling techniques may be used to temporarily or substantially permanently secure the cup 401 to the casing 102.

FIG. 4C shows a network juncture 403*a* for coupling together ends of two temperature sensor cords 100. FIG. 4D is a cross-section view of a network manifold 403*b* for coupling together ends of four temperature sensor cords 100. Embodiments according to the present disclosure may include network couplings for three, five or more cords 100, and may include any geometry that is suitable for propagating combustion across two or more ends.

FIGS. 5A and 5B show two embodiments of a boost initiator 500 that may be coupled at an output end of the linear sensor temperature cord 100. The boost initiator boosts the combustion output of the cord 100 to (1) ignite a propellant fire suppression medium; (2) provide pressure to open a valve; or (3) provide pressure to puncture a sealing disc. FIG. 5A shows a pyrotechnic charge 501 that is initiated by the cord 100. The size and material for the pyrotechnic charge 501 may be tailored to produce a selected quantity of pressure and/or heat, which may directly ignite a propellant type fire suppression medium, operate a valve, or rupture a sealing disc. The material for the pyrotechnic charge 501 may be the same or different from that of the core 101 and/or the additional pyrotechnic material 402.

Referring to the embodiment of the boost initiator 500 shown in FIG. 5B, an integral metallic bulkhead 502 may be placed between two thermally sensitive charges, e.g., a donor charge 503 and a receptor charge 504. The temperature of each charge is sufficient to transfer ignition across the bulkhead 502 without compromising the structural integrity of the bulkhead 502. The size and material for the receptor charge 504 may be tailored to produce a selected quantity of pressure and/or heat 505, which may directly ignite a propellant type fire suppression medium or operate a valve or rupture a sealing disc while maintaining a pressure seal across the bulkhead 502. The material(s) for the donor and receptor charges 503/504 may be the same or different from that of the core 101 and/or the additional pyrotechnic material 402.

Embodiments according to the present disclosure may include several options for a fire suppression medium and its source. Fire suppression mediums may include, e.g., dry chemicals, liquids or inert gases. The sources for dry chemical and liquid fire suppression mediums are typically pressure vessels. Discharging these fire suppression mediums from pressure vessels typically includes opening a valve or rupturing a sealing disc. Inert gas fire suppression mediums are typically combustion products of a propellant that is not stored under pressure. Pressure from an inert gas fire suppression medium may be generated when the propellant is ignited and the resulting combustion produces a pressurized inert gas as the output.

FIGS. 5C-5E show embodiments of initiators, actuators and valves including one of the boost initiators 500. FIG. 5C shows an inert gas generator propellant 510 that is initiated by the pyrotechnic charge 501. Accordingly, an inert gas fire suppression medium is discharged via an outlet 512, e.g., a nozzle, in response to the propellant 510 being ignited or initiated by the pyrotechnic charge 501, which is preferably initiated by the linear sensor temperature cord 100 in response to sensing an elevated temperature that causes auto-ignition of the core 101.

FIG. 5D shows an actuator for discharging a pressurized fire suppression medium 520, e.g., a liquid or dry chemical fire suppression medium. The fire suppression medium 520 is discharged in response to the output of a boost initiator 500 displacing a piston 522, which causes a sealing disc 524 to rupture thus allowing the pressurized fire suppression medium 520 to discharge through an outlet 526. The boost initiator 500 is initiated by the linear sensor temperature cord 100 in response to sensing an elevated temperature that causes auto-ignition of the core 101.

FIG. 5E shows a valve for discharging a pressurized fire suppression medium 530. The fire suppression medium 530 is discharged in response to the output of a boost initiator 500 displacing a piston 532 relative to a valve body 534. Preferably, this causes a shear nipple 536 to be lopped off thus allowing the pressurized fire suppression medium 530 to be discharged through an outlet 538. The boost initiator 500 is initiated by the linear sensor temperature cord 100 in response to sensing an elevated temperature that causes auto-ignition of the core 101.

Embodiments according to the present disclosure may include other configurations and combinations of fire suppression medium sources, discharge controllers and boost initiators. For example, certain embodiments according to the present disclosure may eliminate the boost initiator if the output pressure and/or heat from the linear sensor temperature cord is sufficient to actuate the discharge controller. In lieu of an electrically operated system, auto-ignition of the core of the linear sensor temperature cord in response to sensing an elevated temperature causes the fire suppression medium to be discharged. Also, a network of the linear sensor temperature cords can be provided with different end configurations depending on the type of fire suppression medium and its source.

Figure 6A:
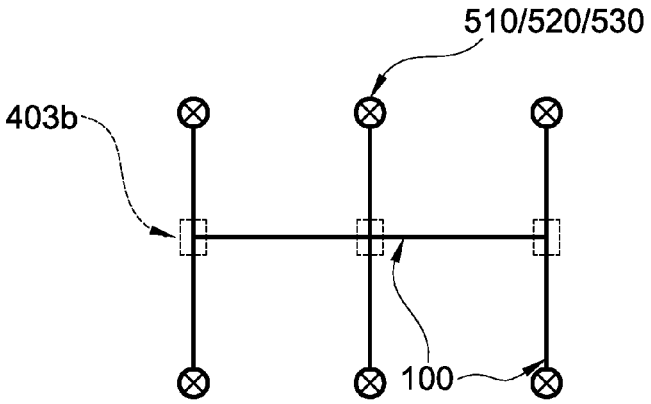
FIGS. 6A-6C are schematic views showing embodiments including multiple linear temperature sensor cords coupled to multiple fire suppression medium sources.
Figure 6B:
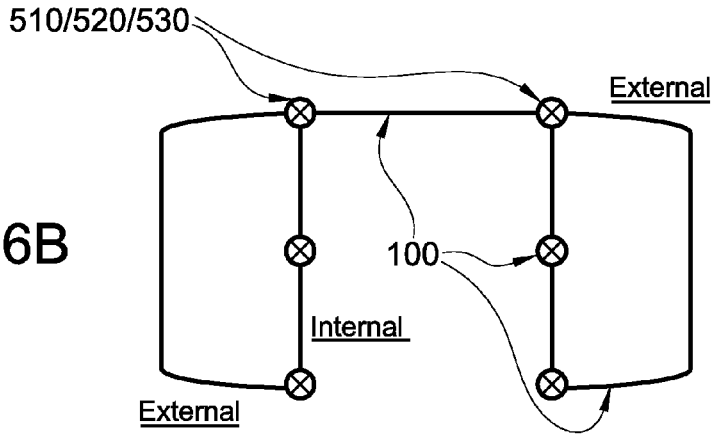
Figure 6C:
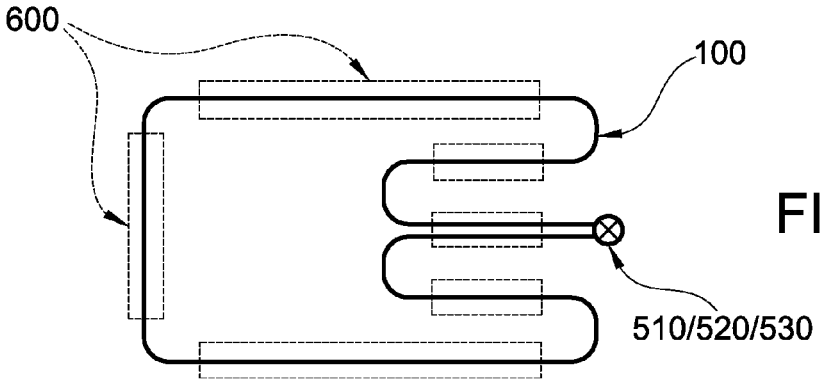

FIGS. 6A-6C schematically show examples of systems that include one or more of the linear temperature sensor cords 100 to initiate a propellant, puncture a disk, or activate a valve on one or more sources of the fire suppression mediums 510/520/530. Preferably, the linear temperature sensor cord(s) connect to one or more inert gas generators. The cord(s) 100 can interface with a boost initiator 500 or directly with an igniter of the inert gas generator for initiating the propellant 510. A solid inert gas generator propellant 510 may be preferable because it does not need to be stored in a pressurized cylinder and there is no residual material to remove or clean up after an inert gas discharge.

FIG. 6A shows six sources of one or more of the fire suppression mediums 510/520/530. A plurality of the linear temperature sensor cords 100 (eight are shown in FIG. 6A) are coupled to sources or one another by network manifolds 403*b* (three are shown in FIG. 6A). In one embodiment according to the present disclosure, four of the six sources may be disposed in corresponding wheel wells of a vehicle and the two additional sources may be disposed proximate to the vehicle's running gear, e.g., in the engine compartment, battery compartment, etc. Core combustion is initiated when the ambient temperature exceeds the auto-ignition temperature of at least one of the cords. The networked cords and sources are accordingly initiated and the fire suppression medium(s) are discharged.

FIG. 6B shows one embodiment according to the present disclosure for providing a fire suppression system in a crew compartment of a vehicle. At least one linear temperature sensor cord 100 (seven are shown in FIG. 6B) is coupled to at least one source (six are shown in FIG. 6B) of a fire suppression medium 510/520/530. The sources are preferably disposed inside a generally enclosed crew compartment and linked by networked cords for initiating the sources if the internal temperature exceeds the auto-ignition temperature. Additional networked cords (two are shown in FIG. 6B) may be used to also initiate the sources if a temperature external to the crew compartment exceeds the auto-ignition temperature.

Certain embodiments according to the present disclosure may include implementing both the fire suppression system for the physical components (FIG. 6A) and the fire suppression system for the crew compartment (FIG. 6B) onboard a single vehicle as independent systems. Moreover, independent systems for additional compartments, e.g., cargo holds, fuel tanks, ammunition lockers, etc., may also be included on a single vehicle. An integrated fire suppression system for a single vehicle may include a network of linear temperature sensor cords that couple together all of the sources onboard the vehicle.

FIG. 6C shows an embodiment according to the present disclosure including a single length of the linear temperature sensor cord 100 and a single source of a fire suppression medium 510/520/530. The single length may include a plurality of individual cords coupled in series by junctions (not shown). The linear temperature sensor cord may extend to several locations in a single compartment and/or may include portions extending into different spaces of a vehicle. Thermal insulators 600 disposed around portions of the cord 100 may provide impact protection and/or reduce sensitivity to elevated temperatures that are routinely anticipated, e.g., proximate an engine exhaust, and therefore do not represent a fire. Preferably, the single source may be dedicated to providing a fire suppression system at a particular location, e.g., a vehicle's driver seat, in response to threats of fire from multiple locations/spaces around the vehicle. One or more of these individual fire suppression systems may be used on a single vehicle, with or without a networked fire suppression system also being onboard the vehicle.

Figure 7A:
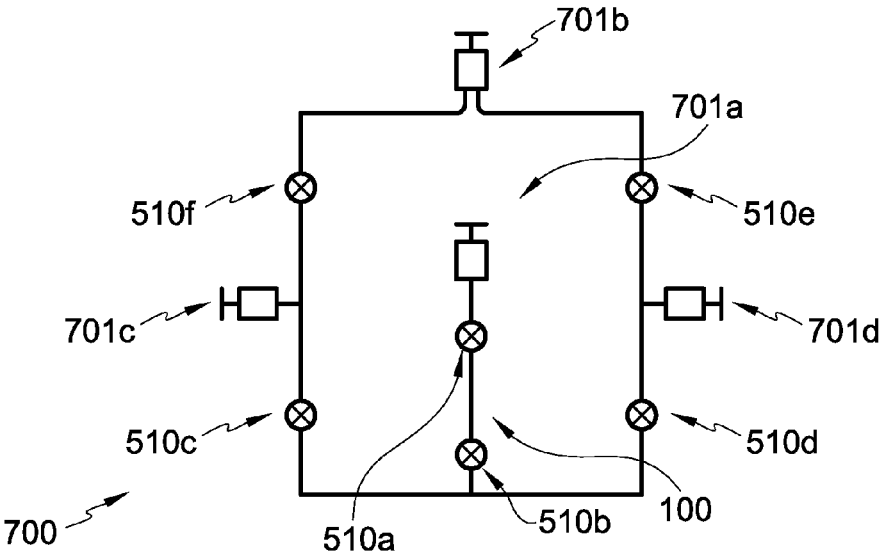
FIG. 7A is a schematic view showing an embodiment including multiple linear temperature sensor cords coupled to multiple fire suppression medium sources and manual initiators.

FIG. 7A schematically shows an embodiment according to the present disclosure of a fire suppression system 700 for a vehicle including a manual initiator 701 that can activate initiation the system 700 at any time or temperature. The system 700 preferably includes a plurality of networked linear temperature sensor cords 100 (only one is indicated in FIG. 7A), a plurality of sources of a fire suppression medium 510/520/530 (six sources including gas generator propellants 510*a*-510*f* are shown in FIG. 7A), and a plurality of manual initiators 701 (four manual initiators 701*a*-701*d* are shown in FIG. 7A).

The sources of the fire suppression medium 510 are preferably distributed for discharging in the engine compartment 510*a*/510*b* and each of the wheel wells 510*c*-510*f*. Alternate or additional sources may also be positioned in other locations on the vehicle.

The manual initiator 701*a* is preferably located in the crew compartment of the vehicle, e.g., within reach of the driver. Alternate or additional manual initiators may be positioned around the exterior of the vehicle. For example, the manual initiator 701*b* may be positioned on the vehicle exterior, e.g., proximate an entrance to the crew compartment at the back of the vehicle, and/or manual initiators 701*c*/701*d* may be positioned on the either of the vehicle's exterior sides.

Figure 7B:
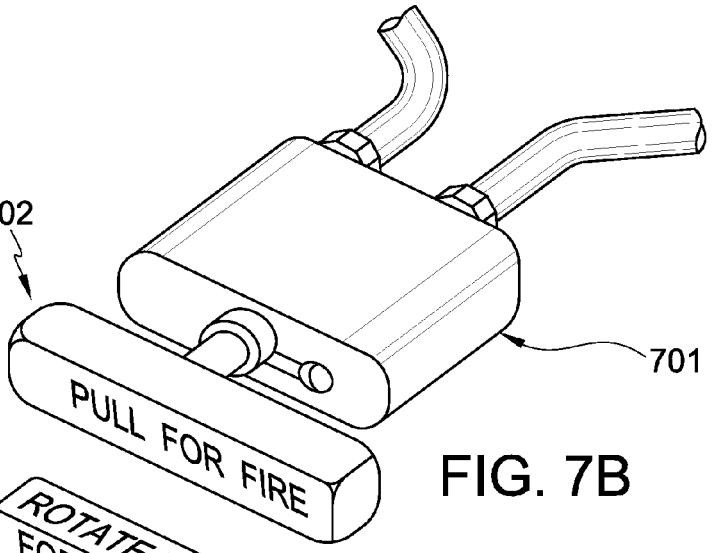
FIGS. 7B and 7C are perspective views of manual initiators shown in FIG. 7A.
Figure 7C:
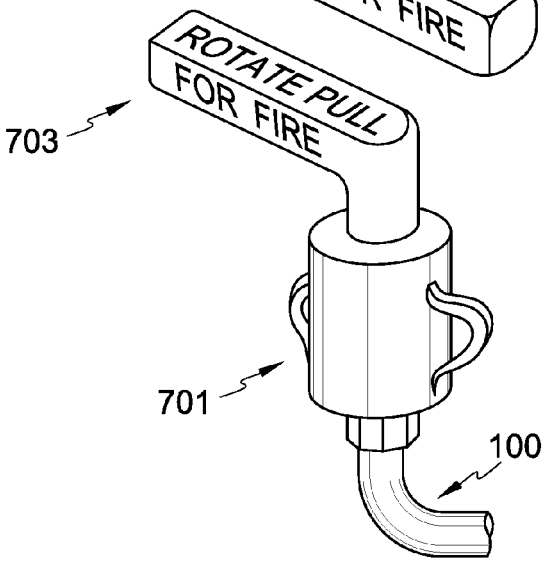

FIGS. 7B and 7C are perspective views of examples of the manual initiators 701 shown in FIG. 7A. FIG. 7B shows an embodiment according to the present disclosure that includes a pull handle 702 for initiating the cord 100 coupled to the manual initiator 701 and FIG. 7C shows an embodiment according to the present disclosure that includes a rotary handle 703 for initiating the cord 100 coupled to the manual initiator 701. In the event of a fire that does not reach the auto-ignition temperature, the manual initiators 701 can be manually activated. The manual initiators 701 are preferably positioned in non-hazardous areas and coupled to the sources of fire suppression medium 510/520/530 with the linear temperature sensor cords 100. An example of a manual initiator is Part Number 813633-3 manufactured by Pacific Scientific Energetic Materials Co. (Hollister, Calif.).

A method for suppressing a fire will now be described. Embodiments according to the present disclosure preferably include a linear temperature sensor cord 100 that, when exposed to a fire having a temperature that exceeds the auto-ignition temperature of the cord 100, initiates combustion of the cord's core 101. This core combustion propagates along the cord 100 to a source of a fire suppression medium 510/520/530 that is preferably positioned in a location to discharge the fire suppression medium 510/520/530 to suppress the fire. Core combustion may propagate in a network of the cords 100 to initiate or actuate one or more suppression medium sources. Likewise, individual suppression medium sources may be activated or initiated in response to core combustion from one or more of the cords 100. Core combustion may provide adequate pressure and/or heat to activate or initiate the fire suppression medium source, or a boost initiator 500 may couple the cord 100 to the source for increasing the pressure and/or heat from the cord 100, and thereby provide sufficient pressure and/or heat to activate or initiate the source. The fire suppression medium sources preferably include a propellant 510 that is initiated to produce a fire suppression medium, a pressurized fire suppression medium 520 that is released by rupturing a sealing disk, or a pressurized fire suppression medium 530 that is released by opening a valve. Embodiments according to the present disclosure discharging the fire suppression medium 510/520/530 without an electrical signal. Accordingly, a fire or damage that disrupts electric power or circuits will not in turn adversely affect the fire suppression performance of embodiments according to the present disclosure.

A method of providing a fire suppression system onboard a vehicle will now be described. Embodiments according to the present disclosure preferably include a linear temperature sensor cord 100 that is routed into or through compartments or other locations on the vehicle such as engine compartments, crew compartments, wheel wells, fuel tanks, cargo holds, etc. The cord 100 may include an end positioned in a compartment or may include a loop or segment disposed in a compartment. Ends of the cord 100 are preferably enclosed by a cup 401, coupled to a boost initiator 500 at a source of a fire suppression medium 510/520/530, coupled directly to the source of the fire suppression medium 510/520/530, coupled to one or more manual initiators 701, or networked with one or more other cords 100 via a juncture 403*a* or a manifold 403*b*. Portions of the cord(s) 100 may be shielded from impact or abrasion with or without an appreciable effect on the temperature sensitivity of the cord 100. For example, one or more portions of a cord 100 may be cinctured by a tube 202 or a sheath 203 with minimal impact on the ability of the cord 100, and/or an insulator 600 may make one or more portions of the cord 100 less sensitive to the ambient temperature. Cords 100 may be bent or otherwise formed into shapes that follow a selected route and may be supported with respect to vehicle along that route by resilient clips, wires, etc. The route that the cord(s) follow may also extend on external surfaces of the vehicle.

Embodiments according to the present disclosure may also be applicable to other environments such as kitchens, warehouses, or any structure in which it is preferable to provide fire suppression capabilities during electrical power outages. Embodiments according to the present disclosure may also be applicable anywhere electricity for a fire suppression system is not available.

Embodiments according to the present disclosure may provide an elongated fire sensor rather than a conventional sensor that is located at a specific position and coupled by wires to a discharge controller. In contrast to these conventional sensors, the entire length of the linear temperature sensor cord 100 may provide fire sensing capabilities in addition to transmitting a signal to discharge a fire suppression medium.

Embodiments according to the present disclosure may also be used to break an electrical circuit. For example, a fire in a particular space may be sensed by an embodiment of the cord according to the present disclosure. The cord may be disposed throughout the space rather than using a conventional sensor(s) disposed at discrete locations. In response to auto-igniting the cord, an embodiment of the boost initiator according to the present disclosure may cut electrical power to the space.

From the foregoing, it will be appreciated that specific embodiments of the invention have been described herein for purposes of illustration, but that various modifications can be made without deviating from the spirit and scope of the invention. Accordingly, the invention is not limited by the specific embodiments.

What is claimed is:

1. A fire suppression system, comprising:

a linear temperature sensor having a thermally sensitive pyrotechnic material with an auto-ignition temperature;

a source of a fire suppression medium; and a boost initiator coupling the linear temperature sensor to the source of the fire suppression medium, wherein the linear temperature sensor is configured such that the thermally sensitive pyrotechnic material is ignited and combustion propagates to the source of the fire suppression medium in response to an ambient temperature reaching the auto-ignition temperature.

2. The system of claim 1 wherein the thermally sensitive pyrotechnic material comprises a fuel and an oxidizer.

3. The system of claim 1 wherein the auto-ignition temperature of the thermally sensitive pyrotechnic material is between approximately 225 degrees Fahrenheit and approximately 800 degrees Fahrenheit.

4. The system of claim 1 wherein the source of the fire suppression medium comprises a propellant that is ignited in response to the combustion of the thermally sensitive pyrotechnic material.

5. The system of claim 1 wherein the source of the fire suppression medium comprises a sealing disc, wherein the sealing disc is ruptured in response to the combustion of the thermally sensitive pyrotechnic material.

6. The system of claim 1 wherein the source of the fire suppression medium comprises a valve, wherein the valve is opened in response to the combustion of the thermally sensitive pyrotechnic material.

7. The system of claim 1 wherein the booster initiator comprises additional pyrotechnic material.

8. The system of claim 7 wherein the booster initiator comprises a bulkhead, a donor charge of pyrotechnic material disposed between the linear temperature sensor and the bulkhead, and a receptor charge disposed between the bulkhead and the source of the fire suppression medium, wherein the donor charge initiates the receptor charge through the bulkhead.

9. The system of claim 8 wherein the bulkhead remains intact when initiating the receptor charge with the donor charge.

10. The system of claim 1, further comprising a core disposed in a hollow casing, wherein at least one of a metallic sheath or a non-metallic cover protects the casing from impact or abrasion and minimally compromises sensitivity of the linear temperature sensor to the ambient temperature.

11. The system of claim 1, further comprising at least one of a junction coupling together two linear temperature sensors and a manifold coupling together at least three linear temperature sensors.

12. The system of claim 1, further comprising a manual initiator coupled to the linear temperature sensor, wherein the manual initiator ignites the thermally sensitive pyrotechnic material regardless of the ambient temperature.

13. A system for sensing an elevated temperature in a space, the system comprising:

a linear temperature sensor comprising a thermally sensitive pyrotechnic material disposed in the space; and a boost initiator coupled to the linear temperature sensor;

wherein the thermally sensitive pyrotechnic material ignites and combustion propagates to the boost initiator in response to at least one portion of the space reaching the auto-ignition temperature.

14. The system of claim 13 wherein the linear temperature sensor is disposed throughout the space.

15. The system of claim 13 wherein the hollow casing of the linear temperature sensor extends to a plurality of spaced portions in the space.

16. The system of claim 13, further comprising a source of a fire suppression medium coupled to the boost initiator.

17. The system of claim 13 wherein the fire suppression medium is configured to be discharged into the space in response to the thermally sensitive pyrotechnic material igniting and combustion propagating to through the core to the source of the fire suppression medium.

18. A system devoid of electrical sensors for an elevated temperature, the system comprising:

a linear temperature sensor including a thermally sensitive pyrotechnic material with an auto-ignition temperature; and a boost initiator coupled to the linear temperature sensor;

wherein the thermally sensitive pyrotechnic material ignites the boost initiator in response to a portion of the linear temperature sensor reaching the auto-ignition temperature.

19. The system of claim 18, wherein the linear temperature sensor comprises:

a hollow casing; and a core disposed in hollow casing, the core including the thermally sensitive pyrotechnic material.

* * * * *